US005872498A

United States Patent [19]

Linek

[11] Patent Number: 5,872,498

[45] Date of Patent: Feb. 16, 1999

[54] RESISTANCE ARRANGEMENT FOR AN ELECTROMAGNETIC SWITCHING DEVICE USEABLE FOR SWITCHING CAPACITIVE LOADS

[75] Inventor: Reiner Linek, Dresden, Germany

[73] Assignee: Allen-Bradley Company, LLC, Milwaukee, Wis.

[21] Appl. No.: 938,055

[22] Filed: Sep. 26, 1997

[30] Foreign Application Priority Data

May 20, 1997 [SE] Sweden ..... 116897

[51] Int. Cl.[6] ..... H01H 67/02

[52] U.S. Cl. ..... 335/132; 335/202

[58] Field of Search ..... 361/8–10, 13; 335/132, 202; 200/295–309

[56] References Cited

U.S. PATENT DOCUMENTS 4,550,356 10/1985 Takahashi ..... 361/13

5,119,261 6/1992 Sonntagbauer ..... 361/8

5,677,655 10/1997 Hinata et al. ..... 335/132

*Primary Examiner*—Lincoln Donovan

*Attorney, Agent, or Firm*—David G. Luettgen; John M. Miller; John J. Horn

[57] ABSTRACT

A resistance arrangement for an electromagnetic switching device (1) is useable for switching capacitive loads with main contact pieces (3) and auxiliary contact pieces (4). One terminal (7) of the auxiliary contact pieces (4) and one terminal (6) of the main contact pieces (3) of the same phase lie on the same side of the switching device (1) stacked on top of each other. The auxiliary contact pieces (4) switch on before the main contact pieces (3) and switch off after them. Between the terminals (6) and (7) of each phase, an ohmic resistance (8) located in a nonconductor housing (13) is connected. The resistance (8) is placed immediately under the terminal (7) of the auxiliary contact piece (4) in the existing cavity (14) of a nonconductor housing (13) expanding into the direction of the terminal (6) of the main contact piece (3). This arrangement can be easily installed and is space-saving.

14 Claims, 1 Drawing Sheet

RESISTANCE ARRANGEMENT FOR AN ELECTROMAGNETIC SWITCHING DEVICE USEABLE FOR SWITCHING CAPACITIVE LOADS

BACKGROUND OF THE INVENTION

1. Field of the Invention

The present invention relates to a resistor arrangement for an electromagnetic switching device useable for switching capacitive loads, wherein the switching device is equipped with main contact pieces and auxiliary contact pieces connected in parallel and at least one terminal of the auxiliary contact pieces and one terminal of the main contact pieces are arranged stacked on top of each other at the same side of the switching device and where, between the terminals of the main and auxiliary contact pieces of each phase, at least one ohmic resistance is connected, and wherein the auxiliary contact pieces switch on before and switch off after the main contact pieces.

2. Description of Related Art

EP-B 1-0058235 describes an electromagnetic switching device of the above-mentioned type. At this switching device, ohmic resistances that are wound from insulated wire are connected between the terminals of the main and auxiliary contact pieces of each phase.

This switching device suffers several disadvantages. First, the wound resistances exhibit insufficient stability and must therefore be limited in their movement with nonconductor ribs between the adjoining phases and towards both edges of the switching device. Second, the resistances protrude from the switching device and thus require a relatively large space. Third, the wound resistances are springy during concussions of the switching device, causing bending stresses at the resistance wire terminals, resulting in a shorter service life of the switching device due to the fatigue failures that are to be expected. Finally, during the installation, it is difficult to connect the unstable resistance wire wound resistances, as they have to be held and guided at both ends.

SUMMARY OF THE INVENTION

The present invention provides a resistance arrangement for an electromagnetic switching device suitable for switching capacitive loads, wherein the required resistances for switching the capacitive loads are mounted inside of the switching device in such a way that each resistance is held with sufficient stability, shows a relatively long service life, can be arranged using little space, and facilitates easy installation.

These objectives are achieved by placing each resistance immediately below the terminal of the auxiliary contact piece into the cavity of a nonconductor housing which expands into the direction of the terminal of the main contact piece. Advantageously, the cavity in the nonconductor housing ensures a good stability of the resistances because of its walls. Additionally, inside the cavity, the resistances are limited in their movement during concussions, so that practically no fatigue failures are to be expected, which results in a relatively long service life of the resistances. Finally, this arrangement is suited for easy installation and is space-saving.

Each resistance can be mounted into the existing cavity below the terminal of the assigned auxiliary contact piece in the housing of the auxiliary contact pieces, which can be separated from the housing of the main contact pieces, and be connected to the one connection on one end of the terminal of the auxiliary contact piece located in the upper area of the cavity, and the other end of each resistance can be brought out of the cavity through an electrical conductor, wherein the free end of the electrical conductor for connecting to the terminal is developed with the same phase of the main contact piece of the auxiliary contact pieces lying in the housing of the main contact pieces. In this manner, the auxiliary switch can be preassembled together with the resistances and be surface-mounted onto the switching device with the main contact pieces, as a rule onto a contactor, if required.

Preferably, the electrical conductor brought out of the cavity is flexible and has electrical insulation. With this electrical conductor, the connection to the resistances on the terminals of the main contact pieces is very easy with this surface-mounted auxiliary switch.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DESCRIPTION OF THE PREFERRED EMBODIMENTS

Figure 1:
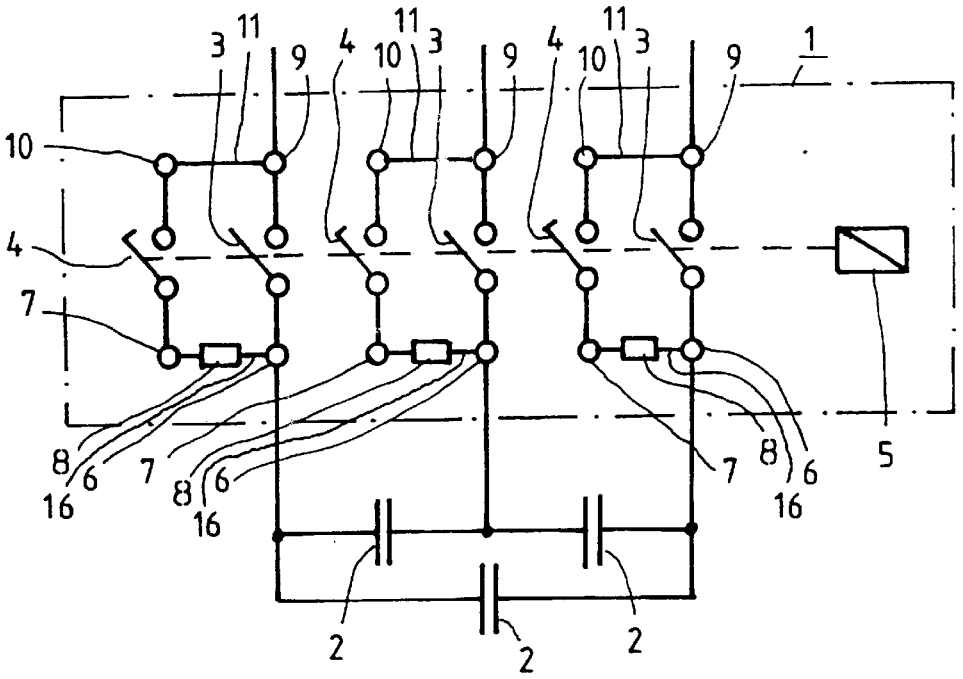
FIG. 1 is a circuit diagram of an electromagnetic switching device with a capacitive load, in accordance with the present invention.

The circuit diagram in FIG. 1 shows an electromagnetic switching device 1 with a capacitive load formed from three capacitors 2. The electromagnetic switching device 1 is equipped with main contact pieces 3 and with auxiliary contact pieces 4, which are actuated through an electromagnet 5. The auxiliary contact pieces 4 are switched on before the main contact pieces 3, and switch off after the main contact pieces 3. Between the terminals 6 of the main contact pieces 3 and the terminals 7 of the auxiliary contact pieces 4, one resistor 8 is connected on each phase. The other terminals 9 and 10 of the main and auxiliary contact pieces 3 and 4, respectively, are electrically connected to each other with connectors 11 in each phase. The main contact pieces 3 are connected in parallel with the auxiliary contact pieces 4 via the resistor 8. The resistors 8 are provided as charging resistors or bleeders for the capacitors 2.

Figure 2:
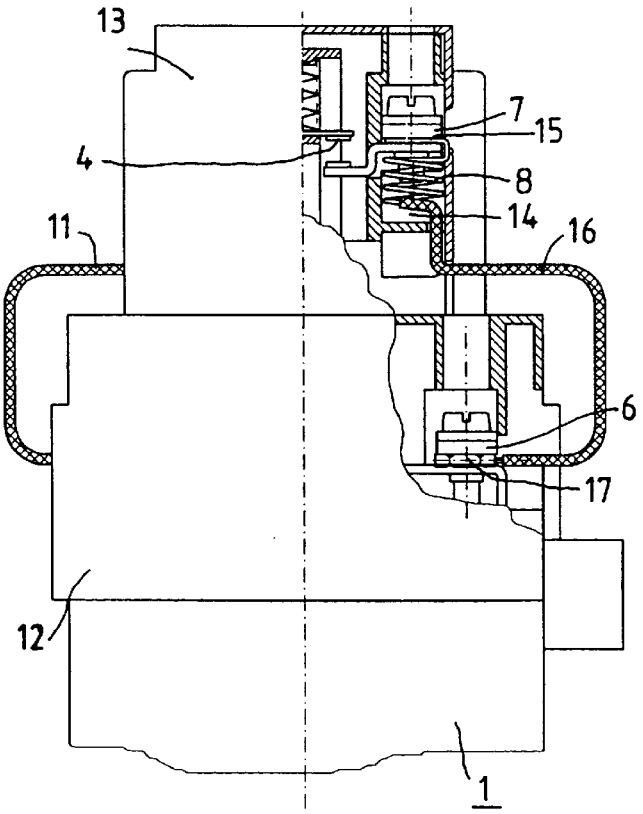
FIG. 2 is a part cross-sectional view of a portion of an electromagnetic switching device, in accordance with the present invention.

FIG. 2 shows a part of an electromagnetic switching device 1, partly shown as a section. The main contact pieces 3 that are not visible in FIG. 2 are placed inside of the housing 12. The auxiliary contact pieces 4 are arranged in housing 13. The housing 12 of the main contact pieces 3 and the housing 13 of the auxiliary contact pieces 4 are connected with each other, but they are mechanically detachable, which has not been detailed. If required, the housing 13 of the auxiliary contacts 4 can be affixed to the housing 12 of the main contact pieces 3, which is usually the housing of an electromagnetic contactor. From FIG. 2, it is seen that the resistor 8 is spring-shaped.

Figure 3:
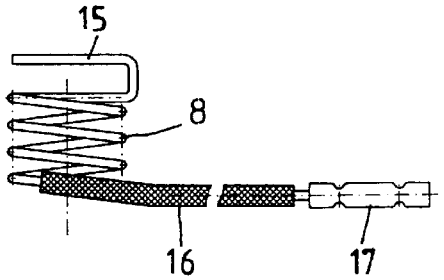
FIG. 3 is an elevated side view of a helical curved resistance with two connections, in accordance with the present invention.
Figure 4:
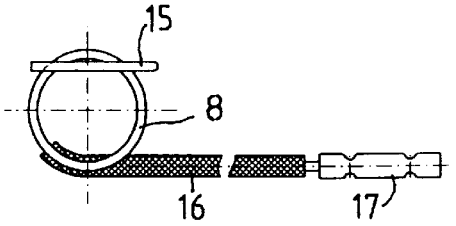
FIG. 4 is a top plan view of the helical curved resistance illustrated in FIG. 3.

The resistor 8 in each phase immediately below the terminal 7 of the auxiliary contact 4, is located in the existing cavity 14 of housing 13, which expands into the direction of terminal 6 of the main contact piece 3. FIGS. 3 and 4 show a side and a plan view of the resistor 8, with the upper connection 15 and the electrical conductor 16, which is connected to the other end of the resistor 8. This resistor 8 is connected with its upper connection 15 onto the terminal 7 of the auxiliary contact piece 4 that lies in the upper area of the cavity. The other end of the resistor 8 is brought out of the cavity 14 with the electrical conductor 16. The electrical resistance that facilitates charging and bleeding the capacitors is provided by the spring-shaped resistors 8; the electrical conductor 16 does not provide any significant resistance. The housing 13 of the auxiliary contacts 4 is fitted with the resistors 8 during manufacture. The connectors 11 and the electrical conductor 16 are available for connecting onto the terminals 6 and 9 of the main contact pieces 3 at the completely assembled housing 13.

In order to simplify connecting the electrical conductor 16 onto the terminal 6, its free end has been provided with a connection piece 17 that can be pushed under the terminal 6. For practical reasons, the electrical conductor 16 is flexible and has been provided with electrical insulation. Alternatively, the resistor wire itself can be used as the electrical conductor 16 brought out of cavity 14. In this case, the part of the resistance wire that is brought out of cavity 14 is electrically insulated.

Many other changes and modifications may be made to the present invention without departing from the spirit thereof. The scope of these and other changes will become apparent from the appended claims.

I claim:

1. A resistor arrangement for an electromagnetic switching device useable for switching capacitive loads, the switching device having main contact pieces and auxiliary contact pieces that are connected in parallel with the main contact pieces and that switch on before and switch off after the main contact pieces, the main contact pieces being located in a main contact housing and the auxiliary contact pieces being located in an auxiliary contact housing, a terminal of the auxiliary contact piece and a terminal of the main contact piece of each phase being arranged stacked on top of each other at the same side of the switching device, the resistor arrangement comprising at least one ohmic resistor electrically connected between the terminal of the main contact piece and the terminal of the auxiliary contact piece of each phase, each resistor being located within the auxiliary contact housing immediately under the terminal of the auxiliary contact piece in an existing cavity of the auxiliary contact housing which expands into the direction of the terminal of the main contact piece.

2. A resistor arrangement according to claim 1, wherein each resistor is fitted into the existing cavity under the terminal of the assigned auxiliary contact piece in the auxiliary contact housing, the auxiliary contact housing being detachable from the main contact housing, and one end of each resistor being connected with one terminal to the terminal of the auxiliary contact piece, the terminal of the auxiliary contact piece being located in the upper area of the existing cavity, and the other end of each resistor being brought out of the cavity by an electrical conductor, the free end of the electrical conductor being adapted for connecting to the terminal of the main contact piece of the same phase when the main contact housing and the auxiliary contact housing are assembled.

3. A resistor arrangement according to claim 2, wherein the electrical conductor brought out of the cavity is flexible and is provided with electrical insulation.

4. An electromagnetic switching device for switching capacitive loads comprising:

a main contact housing, a main contact piece, the main contact piece being located in the main contact housing;

an auxiliary contact housing;

an auxiliary contact piece, the auxiliary contact piece being located in the auxiliary contact housing, the auxiliary contact piece being connected in parallel with the main contact piece, the auxiliary contact piece having first and second terminals; and a resistor, a first terminal of the resistor being electrically connected to the first terminal of the auxiliary contact piece, a second terminal of the resistor being electrically connected to a first terminal of the main contact piece, and the resistor being located within the auxiliary contact housing immediately adjacent the first terminal of the auxiliary contact piece in a cavity of the auxiliary contact housing.

5. A switching device according to claim 4, wherein the auxiliary contact housing is detachable from the main contact housing.

6. A switching device according to claim 5, wherein the second terminal of the resistor is brought out of the cavity by an electrical conductor, the electrical conductor connecting the second terminal of the resistor to the first terminal of the main contact piece.

7. A switching device according to claim 6, wherein the electrical conductor brought out of the cavity is flexible and is provided with electrical insulation.

8. A switching device according to claim 4, wherein the first terminal of the auxiliary contact piece is stacked on top of the first terminal of the main contact piece.

9. A switching device according to claim 4, wherein the cavity extends from the first terminal of the auxiliary contact piece in the direction of the first terminal of the main contact piece.

10. A switching device according to claim 4, wherein the auxiliary contact piece switches on before and switches off after the main contact piece.

11. A switching device according to claim 4, wherein the switching device comprises multiple auxiliary contact pieces which connect in parallel with multiple main contact pieces, and wherein the switching device is useable in conjunction with a multi-phase capacitive load.

12. An electromagnetic switching device for switching capacitive loads comprising:

A. a main contact housing;

B. an auxiliary contact housing, the auxiliary contact housing being detachable from the main contact housing;

C. first, second and third main contact pieces, 1. the first, second and third main contact pieces being disposed in the main contact housing, and 2. each of the first, second and third main contact pieces having first and second terminals;

D. first, second and third auxiliary contact pieces which switch on before and switch off after the first, second and third main contact pieces, 1. the first, second and third auxiliary contact pieces being disposed in the auxiliary contact housing,
2. the first, second and third auxiliary contact pieces each having first and second terminals,
   a. the first terminal of the first auxiliary contact piece being stacked on top of the first terminal of the first main contact piece,
   b. the first terminal of the second auxiliary contact piece being stacked on top of the first terminal of the second main contact piece, and
   c. the first terminal of the third auxiliary contact piece being stacked on top of the first terminal of the third main contact piece, and
3. the first auxiliary contact piece being connected in parallel with the first main contact piece, the second auxiliary contact piece being connected in parallel with the second main contact piece, and the third auxiliary contact piece being connected in parallel with the third main contact piece; and E. first, second and third resistors, 1. the first resistor being connected between the first terminal of the first auxiliary contact piece and the first terminal of the first main contact piece, the second resistor being connected between the first terminal of the second auxiliary contact piece and the first terminal of the second main contact piece, and the third resistor being connected between the first terminal of the third auxiliary contact piece and the first terminal of the third main contact piece,
2. a. the first resistor being located immediately under the first terminal of the first auxiliary contact piece in a first cavity of the auxiliary contact housing, the first cavity extending from the first terminal of the first auxiliary contact piece in the direction of the first terminal of the first main contact piece,
   b. the second resistor being located immediately under the first terminal of the second auxiliary contact piece in a second cavity of the auxiliary contact housing, the second cavity extending from the first terminal of the second auxiliary contact piece in the direction of the first terminal of the second main contact piece, and
   c. the third resistor being located immediately under the first terminal of the third auxiliary contact piece in a third cavity of the auxiliary contact housing, the third cavity extending from the first terminal of the third auxiliary contact piece in the direction of the first terminal of the third main contact piece, and
3. a. one end of the first resistor being brought out of the first cavity by a first electrical conductor, the first electrical conductor connecting the one end of the first resistor to the first terminal of the first main contact piece,
   b. one end of the second resistor being brought out of the second cavity by a second electrical conductor, the second electrical conductor connecting the one end of the second resistor to the first terminal of the second main contact piece, and
   c. one end of the third resistor being brought out of the third cavity by a third electrical conductor, the third electrical conductor connecting the one end of the third resistor to the first terminal of the third main contact piece.

13. A resistor arrangement according to claim 1, wherein each resistor is spring-shaped.

14. A switching device according to claim 4, wherein the resistor is spring-shaped.

* * * * *